United States Patent [19]

Ciszek

[11] Patent Number: 4,572,812

[45] Date of Patent: Feb. 25, 1986

[54] METHOD AND APPARATUS FOR CASTING CONDUCTIVE AND SEMICONDUCTIVE MATERIALS

[75] Inventor: Theodore F. Ciszek, Evergreen, Colo.

[73] Assignee: The United States of America as represented by the Secretary of Energy, Washington, D.C.

[21] Appl. No.: 640,286

[22] Filed: Aug. 13, 1984

[51] Int. Cl.[4] ..... B29D 7/02; B22D 27/02

[52] U.S. Cl. ..... 264/25; 264/61; 425/174.8 R; 164/467; 164/503

[58] Field of Search ..... 425/174.2, 174.4, 174.8 R; 264/26, 61, 25; 164/147.1, 466, 467, 498, 503

[56] References Cited

U.S. PATENT DOCUMENTS 4,116,598 9/1978 Alexandrov et al. ..... 425/174.8 R
4,358,416 11/1982 Yarwood et al. ..... 264/26 X
4,452,297 6/1984 Ungarean et al. ..... 164/467
4,465,118 8/1984 Dantzig et al. ..... 164/467 X
4,469,165 9/1984 Ungarean et al. ..... 164/467

*Primary Examiner*—J. Howard Flint, Jr.
*Attorney, Agent, or Firm*—Kenneth L. Richardson; John M. Albrecht; Judson R. Hightower

[57] ABSTRACT

A method and apparatus is disclosed for casting conductive and semiconductive materials. The apparatus includes a plurality of conductive members arranged to define a container-like area having a desired cross-sectional shape. A portion or all of the conductive or semiconductive material which is to be cast is introduced into the container-like area. A means is provided for inducing the flow of an electrical current in each of the conductive members, which currents act collectively to induce a current flow in the material. The induced current flow through the conductive members is in a direction substantially opposite to the induced current flow in the material so that the material is repelled from the conductive members during the casting process.

20 Claims, 5 Drawing Figures

METHOD AND APPARATUS FOR CASTING CONDUCTIVE AND SEMI CONDUCTIVE MATERIALS

The United States Government has rights in this invention pursuant to Contract No. DE-AC02-83CH10093 between the U.S. Department of Energy and the Solar Energy Research Institute, a division of the Midwest Research Institute.

BACKGROUND OF THE INVENTION

1. Field of the Invention

The present invention is directed to a method and apparatus for casting conductive and semi conductive materials, and more particularly, to a method and apparatus for casting such materials in a substantially continuous manner with minimal contamination of the cast material.

2. Description of the Prior Art

It is known that conductive and semi conductive materials can be cast into ingots having specific cross-sectional shapes. To date, processes for casting such materials have employed batch casting techniques wherein a predetermined amount of feed material, in either a solid or molten state, is introduced into a casting mold having a specific cross-sectional shape. If the feed material is introduced into the mold in a solid state, a means for melting the material is provided. Once the feed material is in a molten state, the material is allowed to solidify and cool within the mold to produce a cast ingot having a desired cross-sectional shape, as determined by the configuration of the inner walls of the mold.

Such batch casting processes suffer from at least two common drawbacks. First, since the cast ingots are produced on a batch-by-batch basis, the overall production of ingots is limited by the number of casting molds available for use at any one time, and is further limited by the lengthy production time which is required for the melting, solidification and cooling of each batch. Second, in all known batch processes, the feed material is allowed to contact the inner walls of the casting mold during the melting and/or solidification stages. When the production of a high purity ingot is desired, such contact is detrimental since contaminants from the inner walls of the mold are introduced into the molten material and become entrapped in the crystalline structure of the resultant ingot. In addition, when an ingot having large crystalline grain sizes is desired, contact between the molten material and inner walls of the mold during solidification is detrimental due to the effects of wall nucleation.

SUMMARY OF THE INVENTION

It is thus one object of the present invention to provide a method and apparatus which allows for the substantially continuous casting of conductive and semi conductive materials into ingots which have predetermined cross-sectional shapes.

It is another object of the invention to provide a method and apparatus for casting such a material in such a manner that the material does not substantially contact the inner walls of a casting mold during the melting, solidification, and/or cooling stages of the casting process.

It is still another object of the present invention to provide a method and apparatus for casting such materials in such a manner that slag or floating debris within the casting environment will have no major effect on the quality of the resultant cast ingot.

It is yet another object of the present invention to provide a method and apparatus for casting conductive and semi conductive materials wherein heat from the molten material may be quickly and efficiently removed to allow for rapid solidification and cooling of the resultant ingot.

It is still another object of the present invention to provide a method and apparatus for casting such a material wherein the feed material may be introduced in a wide variety of shapes and sizes.

Additional objects, advantages, and novel features of the invention will be set forth in part in the description which follows, and in part will become apparent to those skilled in the art upon examination of the following, or may be learned by practice of the invention. The objects and advantages of the invention may be realized and attained by the means of the instrumentalities and combinations set forth in the appended claims.

In accordance with the present invention, an apparatus is provided which comprises a plurality of electrically conductive members arranged in a side-to-side manner so as to define a container-like area having an open top and bottom. The apparatus further comprises a means for inducing high frequency AC electrical currents in each of the conductive members. Finally, a retractable support member is provided through the open-ended bottom of said container-like area.

In the operation of the present invention, the support member is initially positioned inward of the open-ended bottom of the container-like area. The inducing means is then energized to magnetically induce a current flow in each conductive member which is adjacent to the inducing means.

A conductive or semi conductive feed material is then introduced into the top of the container-like area in either a melted or solid state. The support member acts to support the feed material. If the feed material that is introduced is in a solid state and is of a semi conductive nature, direct heating means will initially be required to bring the feed material to an elevated temperature, unless the feed material has been previously treated with an appropriate dopant. If a conductive feed material is introduced in a solid state, no heating means will be required.

The aforementioned induced currents in the conductive members act collectively to magnetically induce an electrical current primarily in that portion of the feed material which is adjacent to the inducing means. The induced current in the material heats the material to, and/or maintains the material, in a molten state. The induced current flow in the material travels in a direction substantially opposite to the induced currents which flow through each of the conductive members, and as a result, the material is repelled from the conductive members. Such repulsion tends to keep the feed material from coming into direct contact with the inner walls of the conductive members during the casting process, and thereby prevents contamination of the material.

As the support member is slowly lowered away from that portion of the container-like area which is adjacent to the inducing means, the bottommost portion of the molten material solidifies without substantial contact with the inner walls of the conductive members due to the aforementioned repulsive electrical currents. Since the material does not come into contact with the conductive members as it solidifies, wall nucleation is avoided and the resultant crystalline grain sizes in the cast ingot are maximized. As the solidification process continues, new feed material can be introduced into the top of the container-like area. The new feed material can be added at such a rate that it can be melted with the preexisting molten feed material in the container-like area. The continued solidification and addition of material in the apparatus results in a process that is substantially continuous in nature, and is capable of producing large, high-purity ingots having a desired cross-sectional shape.

BRIEF DESCRIPTION OF THE DRAWINGS

The accompanying drawings, which are incorporated in and form a part of the specification, illustrate one embodiment of the present invention, and together with the description, serve to explain the principles of the invention.

FIG. 3A-14 C are a series of cross-sectional views showing said one embodiment at progressively advanced stages of the casting of a conductive or semi conductive material.

DETAILED EXPLANATION OF A PREFERRED EMBODIMENT

The following is a detailed description of one embodiment of the present invention. Other embodiments will be apparent to those skilled in the art.

Figure 1:
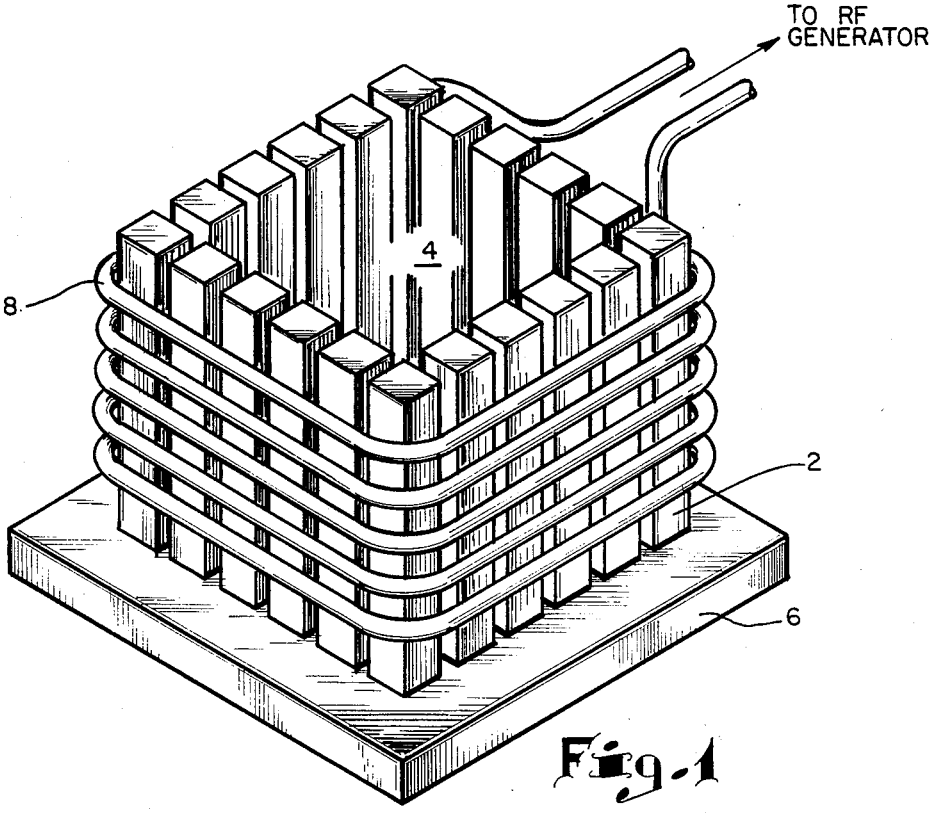
FIG. 1 is a perspective view of one embodiment of the apparatus employed in the present invention.

In accordance with said one embodiment of the present invention, FIG. 1 shows a perspective view of a casting apparatus. As illustrated, the apparatus comprises a plurality of electrically conductive vertical members 2 arranged in a side-to-side manner so as to define a container-like area 4 having an open top and bottom. The vertical members 2 cannot touch each other, but may be affixed to a common base member 6, (by silver soldering techniques or the like). Each vertical member 2 is provided with inner longitudinal passageways 20 to accommodate the flow of a cooling liquid therethrough. By way of example, the vertical members 2 may be made of copper tubing.

It should be appreciated that the vertical members 2 can be arranged so as to define a specific cross-sectional shape within said container-like area 4. As will become apparent, the cross-sectional shape within the container-like area 4 will determine the cross-sectional shape of the ingot end product that can be produced through the utilization of the disclosed invention.

Figure 2:
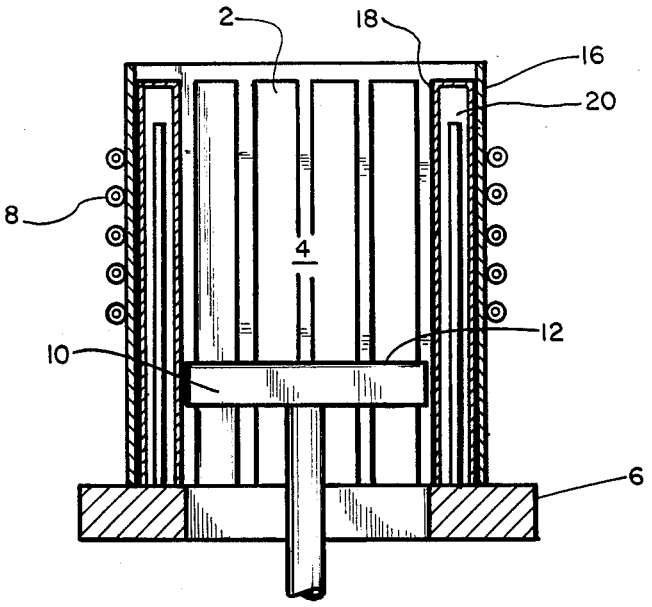
FIG. 2 is a cross-sectional view of said one embodiment of the apparatus of the present invention.

The apparatus further comprises a radio frequency (RF) induction heating coil 8 that preferably has more than one turn. The RF coil 8 may be positioned so as to encircle a top portion of the aforementioned plurality of vertical members 2, but the RF coil 8 cannot be allowed to directly contact any of the vertical members 2. As illustrated in FIG. 2, a shield 16 may be interposed between the vertical members 2 and the RF coil 8 to prevent electrical arcing between the vertical members 2 and the RF coil 8, and may, for example, be comprised of a material such as quartz.

A vertically retractable support member 10 is provided through the open-ended bottom of said container-like area 4. The support member 10 may be designed to have a top surface 12 which is substantially the same shape as that defined by a horizontal cross section of the container-like area 4. To accommodate substantially vertical movement of the support member 10 within the container-like area 4, the top surface 12 of the support member 10 may have slightly smaller dimensions than said horizontal cross-section of the container-like area 4. The support member 10 may, for example, be comprised of a material such as graphite.

Figure 3C:
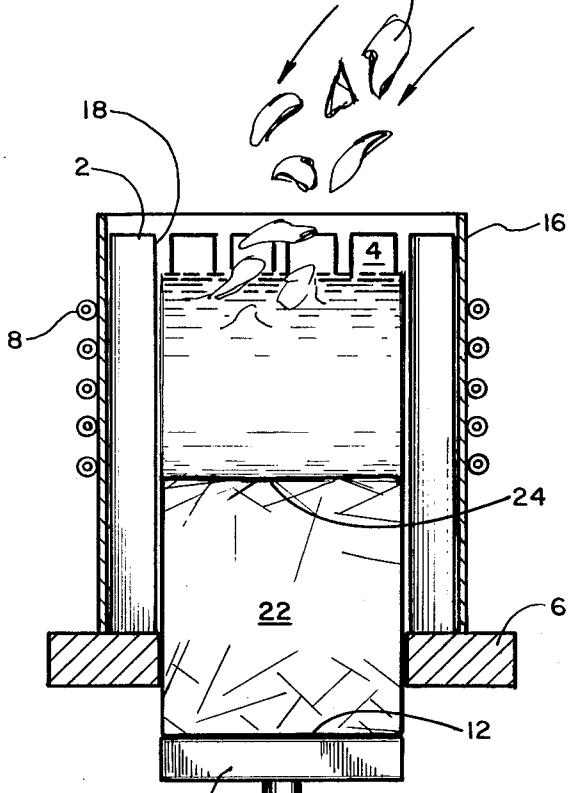
Figure 3B:
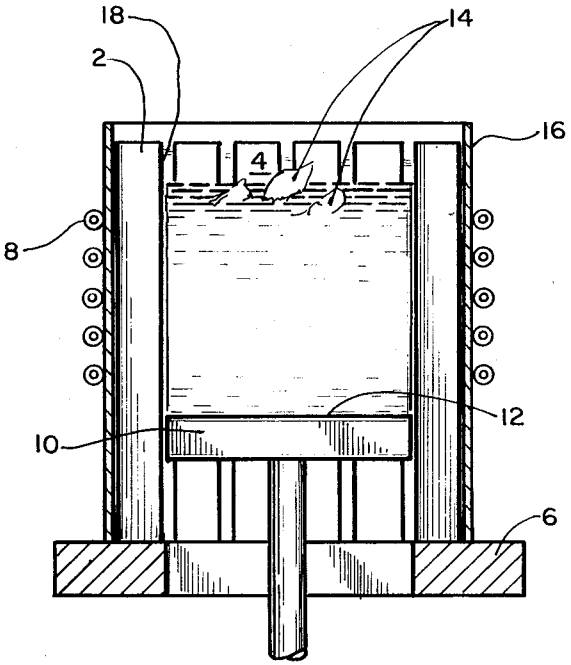
Figure 3A:
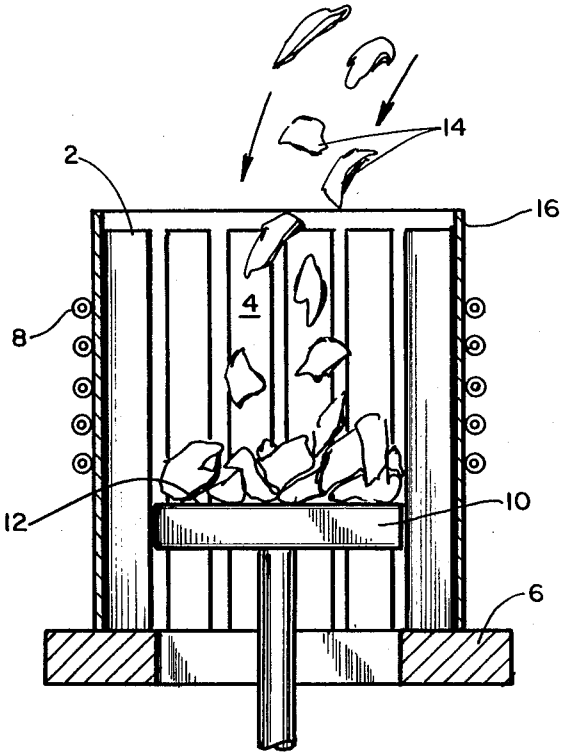

In the operation of the present invention, the support member 10 may initially be positioned inward of the open-ended bottom of the container-like area 4 so that the top surface 12 of the support member 10 is approximately even with the bottommost turn of the RF coil 8, (See FIG. 3A). Cooling liquid is then circulated through the passageways 20 of the vertical members 2, and the RF coil 8 is energized. The electric power that is supplied to the RF coil may, for example, come from an electric generator. The electric current flow through the turns of the RF coil 8 magnetically induces a common current flow primarily in that portion of each of the vertical members 2 which is surrounded by said RF coil 8. As such, each of the vertical members 2 acts as a one-turn step-down secondary transformer winding. The cooling liquid which circulates through the passageways 20 of the vertical members 2 tends to prevent the vertical members 2 from becoming overheated in response to the induced current flow therethrough.

As shown in FIG. 3A, a conductive or semi conductive feed material 14 is then introduced into the top of the container-like area 4. The feed material 14 may be in either a solid state, as shown in FIG. 3A, or in a molten state. It should be appreciated that solid feed material 14 may be introduced in a variety of shapes and sizes without substantially affecting the operation of the disclosed apparatus. The top surface 12 of the support member 10 acts to vertically support the feed material 14 that is introduced. If the feed material 14 is semi conductive, and is introduced into the appartus in a solid form, an auxilliary heating means will be required to bring the feed material 14 to an elevated temperature within the container-like area 4, at which point the feed material 14 will become conductive and will be directly heated by the induced RF currents in the vertical members 2. The aforementioned heating means could, for example, be a graphite heating rod which is brought into direct contact with the solid semi conductive feed material 14. If the support member 10 is made of a conductive material (e.g. graphite), it will be heated by the induced RF currents in the vertical members 2, and will function as the auxiliary heating means. If the feed material 14 is a solid conductive material, auxiliary heating means will not be required.

The aforementioned currents that are induced in the vertical members 2 act collectively to magnetically induce a radio frequency (RF) current in primarily that portion of the material 14 which is surrounded by the RF coil 8. As illustrated in FIG. 3B, the induced RF current in the material 14 heats the material 14 to, and/or maintains the material 14, in a molten state. By way of information, the power that is applied to the RF coil 8 may be limited to that which is necessary to induce a current in the feed material 14 that is sufficient to allow the material 14 to achieve a molten state.

As is known in the art, many materials will oxidize when brought to a molten state under typical atmospheric conditions. The oxidation will typically result in a layer of slag on the surface of the molten material.

Since the presence of slag in casting processes is generally undesirable, it is noted that the present invention may be carried out in a controlled atmosphere, (e.g., in vacuum conditions or in the presence of an inert gas), to minimize the production of slag. Various means are known in the art for providing a controlled atmosphere for the casting of conductive and semi conductive materials.

Referring again to FIG. 3B, the aforementioned induced current flow in the molten material 14 is, at any instant of time, in a direction substantially opposite to the currents flowing through the vertical members 2, and as a result, the molten material 14 is repelled from the vertical members 2. Such repulsion tends to keep the molten material 14 from coming into direct contact with the inner walls 18 of the vertical members 2, and thereby substantially prevents the introduction of contaminants from the innner walls 18 into the molten material 14 during the casting process. As such, it should be apparent that the present invention provides a novel apparatus and method for producing high purity ingots.

As the retractable support member 10 is slowly lowered away from that portion of the container-like area 4 which is surrounded by the RF coil 8 (see FIG. 3C), the induced current flow in the bottommost portion of the molten material 14 gradually decreases, and such bottommost portion gradually solidifies into a cast ingot 22 without substantial contact with the inner walls 18 of the vertical members 2. The solidification of the molten material 14 may be accelerated by the cool liquid flowing through the passageways 20 of the vertical members 2, which cool liquid disperses the radiated heat of fusion occasioned by the solidification. Since the molten material 14 is substantially prevented from contacting the vertical members 2 as it solidifies into an ingot 22, wall nucleation is avoided and the crystalline grain sizes in the resultant ingot 22 are maximized.

It should be noted that in the operation of the disclosed invention, the molten material 14 solidifies into an ingot 22 at a submerged interface 24 (see FIG. 3C). As a result, any slag and undesirable contaminants which may rise to the top of the molten material 14 within the apparatus are not incorporated into the ingot 22. This factor further contributes to the obtainment of a high purity ingot 22.

As the solidification of molten material 14 continues, the support member 10 is gradually lowered out of the container-like area 4, and additional feed material 14 can be introduced into the top of the container-like area 4, as shown in FIG. 3C. The new feed material 14 can be added at such a rate that it can be melted together with the preexisting molten material 14 in the container-like area 4. The continued solidification of molten material 14 into the cast ingot 22, and addition of feed material 14 at a matching rate, yields a method for casting conductive and semi conductive materials that is substantially continuous in nature. As such, high ingot production can be achieved through the utilization of the disclosed invention.

The disclosed invention is particularly well suited for the casting of silicon into high purity ingots having large crystalline grain sizes. Such ingots may be further processed for photovoltaic applications where high purity silicon components are desired, and where the production of photovoltaic power can be maximized through the employment of silicon components having large crystalline grain sizes.

In one experimental embodiment of the invention, 16 vertical copper members were employed. Each had a 6 mm×6 mm square cross section, and each was 104 mm long. They were arranged vertically to form a 26 mm×26 mm square confinement cross section with slightly octahedral corners. Each copper member was attached to a common base with silver solder and each was provided with water cooling means. A 5-turn copper RF coil with two outer turns of 83 mm inside diameter, and 3 inner turns of 61 mm inside diameter was used. The coil was 38 mm high and was placed with its midplane 34 mm below the tops of the vertical copper members. A 2 mm thick quartz arc shield was placed concentrically between the coil and the array of vertical members. A graphite support member was used. Twelve grams of silicon was then placed on the support member such that it was in the midplane of the coil. An RF generator was used to power the RF coil at 464 kHz frequency, and 6.8 KW power. Within 7 minutes, the radiated heat from the graphite support member warmed the silicon to a point at which the silicon was able to conduct induced RF currents. Next, the power was increased to 10.3 KW to melt the 12 grams of silicon. Then a 20 mm diameter solid silicon rod was introduced into the open top of the confinement area and contacted with the molten silicon. At this point, the power was increased to 15.7 KW, the support member was retracted downward at 2.5 mm/min, and the silicon feed rod was fed into the confinement area at 5.4 mm/min. After 1 hour and 10 minutes of operation, the feed rod was completely consumed, and a 17 cm long cast silicon ingot was produced. The cast ingot had a substantially square cross section, (approximately 25 mm × 25 mm).

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention as defined by the claims which follow.

The embodiments of the invention in which an exclusive property or privilege is claimed are defined as follows:

1. An apparatus for use in a process for casting a conductive or semiconductive material, comprising:

a plurality of conductive members arranged to be spaced from one another so as to define a container-like area for receiving and containing said material; and means for inducing first electrical currents in each of said conductive members, which first electrical currents act collectively to induce a second electrical current in said material, which said second electrical current flows in a direction substantially opposite to the common direction of flow of said first electrical currents, so that said material is repelled away from and substantially prevented from contacting said conductive members during the casting of said material.

2. An apparatus, as set forth in claim 1, wherein said material is in a molten state for at least part of the time during the casting process.

3. An apparatus, as set forth in claim 2, wherein said conductive members are arranged substantially vertically in a side-by-side manner so that said container-like area has an open top and bottom, and further comprising a vertically retractable support means initially disposed inward the bottom of said container-like area for supporting said material, said retractable support means capable of being vertically lowered out of and away from said bottom of said container-like area in such a manner that molten material that is supported by said retractable support means will solidify into a cast ingot as said molten material is lowered away from said conductive members, so that as said retractable support means is vertically lowered additional material may be received within said top of said container-like area to yield a substantially continuous casting process.

4. An apparatus, as set forth in claim 3, further comprising a means for providing a controlled atmosphere for carrying out said casting process.

5. An apparatus, as set forth in claim 3, wherein said conductive members are arranged to define a container-like area having a desired cross-sectional shape, and wherein said cast ingot has a cross-sectional shape that is substantially similar to said desired cross-sectional shape.

6. An apparatus, as set forth in claim 5, wherein cooling liquid is circulated through each of said conductive members to cool said conductive members.

7. An apparatus, as set forth in claim 6, wherein said first electrical currents are induced in substantiallly an upper portion of each of said conductive members, so that said second electrical current is only induced in substantially that portion of said material which is juxtaposed to said upper portions of said conductive members, so that said molten material will gradually solidify into said cast ingot as said molten material is lowered away from said upper portions of said conductive members, and so that said cooling liquid accelerates the solidification of said molten material by removing from the apparatus the heat of fusion occasioned by said solidification.

8. An apparatus, as set forth in claim 6, wherein said inducing means is a radio frequency induction heating coil, and wherein said induction heating coil is positioned to encircle at least portions of said plurality of conductive members.

9. An apparatus as set forth in claim 8, wherein a shield is interposed between said induction heating coil and said plurality of conductive members to prevent electrical arcing therebetween.

10. An apparatus for casting a conductive or semiconductive material in a substantially continuous manner, comprising:

a plurality of conductive members arranged substantially vertically in a side-by-side manner to define a container-like area for receiving and containing said material, said container-like area having an open top and bottom, and having a desired cross-sectional shape;

means for inducing first electrical currents in each of said conductive members, which first electrical currents act collectively to induce a second electrical current in said material, which said second electrical current causes said material to be in a molten state for at least part of the time during said casting process, and which said second electrical current flows in a direction substantially opposite to the common direction of flow of said first electrical currents, so that said material is repelled away from and substantially prevented from contacting said conductive members during the casting of said material; and a vertically retractable support means initially disposed inward said bottom of said container-like area for supporting said material, said retractable support means capable of being vertically lowered out of and away from said bottom of said container-like area in such a manner that molten material that is supported by said retractable support means will solidify into a cast ingot as said molten material is lowered away from said conductive members, said ingot having a cross-sectional shape which is substantially the same as said desired cross-sectional shape, so that as said retractable support means is vertically lowered additional material may be received within said top of said container-like area to yield a substantially continuous casting process.

11. A method for use in a process for casting a conductive or semi conductive material, comprising:

arranging a plurality of conductive members to be spaced from one another so as to define a container-like area;

introducing said material into said container-like area;

inducing first electrical currents in each of said conductive members;

using said first electrical currents to induce a second electrical current in said material, which said second electrical current flows in a direction substantially opposite to the common direction of flow of said first electrical currents; and employing said first electrical currents and said second electrical current so that said material is repelled away from and is substantially prevented from contacting said conductive members during the casting of said material.

12. A method, as set forth in claim 11, wherein said material is in a molten state for at least part of the time during the casting process.

13. A method, as set forth in claim 12, wherein said arranging step further comprises positioning said conductive members substantially vertically in a side-by-side manner so that said container-like area has an open top and bottom, and so that said container-like area has a desired cross-sectional shape.

14. A method, as set forth in claim 13, further comprising the step of supplying a means for providing a controlled atmosphere for carrying out said casting process.

15. A method, as set forth in claim 13, further comprising:

providing a vertically retractable support means inward of said bottom of said container-like area to support said material;

retracting said retractable support means vertically downward and away from said container-like area in such a manner that molten material that is supported by said retractable support means will solidify into a cast ingot as said molten material is lowered away from said conductive members, said ingot having a cross-sectional shape which is substantially the same as said desired cross-sectional shape;

supplying additional amounts of said material into said top of said container-like area; and repeating said using, employing, retracting and supplying steps to yield a substantially continuous casting process.

16. A method, as set forth in claim 15, further comprising the step of circulating liquid through each of said conductive members during the casting process to cool said conductive members.

17. A method, as set forth in claim 16, wherein in said inducing step said first electrical currents are induced in substantially an upper portion of each of said conductive members so that said second electrical current is induced in substantially that portion of said material which is juxtaposed to said upper portions of said conductive members, so that said molten material will gradually solidify into said ingot as said molten material is lowered away from said upper portions of said conductive members, and so that said cooling liquid accelerates the solidification of said molten material by removing from said container-like area the heat of fusion occasioned by said solidification.

18. A method, as set forth in claim 16, wherein in said inducing step a radio frequency induction heating coil is employed to induce said first electrical currents, and further comprising the step of positioning said induction heating coil to encircle at least portions of said plurality of conductive members.

19. A method, as set forth in claim 18, further comprising the step of interposing a shield between said induction heating coil and said plurality of conductive members to prevent electrical arcing there between.

20. A method for casting a conductive or semi-conductive material in substantially a continuous manner, comprising:

arranging a plurality of conductive members substantially vertically in a side-by-side manner to define a container-like area having an open top and bottom, and having a desired cross-sectional shape;

introducing said material into said container-like area;

inducing first electrical currents in each of said conductive members;

using said first electrical currents to induce a second electrical current in said material, which said second electrical current causes said material to be in a molten state for at least part of the time during said casting process and which said second electrical current flows in a direction substantially opposite to the common direction of flow of said first electrical currents;

employing said first electrical currents and said second electrical current so that said material is repelled away from and is substantially prevented from contacting said conductive members during the casting of said material;

providing a vertically retractable support means inward of said bottom of said container-like area to support said material;

retracting said retractable support means vertically downward and away from said container-like area in such a manner that molten material that is supported by said retractable support means will solidify into an ingot as said molten material is lowered away from said conductive members, said ingot having a cross-sectional shape which is substantially the same as said desired cross-sectional shape;

supplying additional amounts of said material into said top of said container-like area; and repeating said using, employing, retracting and supplying steps to yield a substantially continuous casting process.

* * * * *